US006705950B2

(12) United States Patent
Wood et al.

(10) Patent No.: US 6,705,950 B2
(45) Date of Patent: Mar. 16, 2004

(54) NON-MOTORIZED OBJECT HANGER

(75) Inventors: Steve Wood, Kutztown, PA (US); Dennis Stauffer, Birdsboro, PA (US); Jesslyn E. Tankel, Redwood City, CA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 10/127,698

(22) Filed: Apr. 23, 2002

(65) Prior Publication Data

US 2003/0199328 A1 Oct. 23, 2003

(51) Int. Cl.[7] ..... A63G 9/02
(52) U.S. Cl. ..... 472/118; 472/119; 446/227
(58) Field of Search ..... 472/118–125; 446/227; 297/273

(56) References Cited

U.S. PATENT DOCUMENTS

| | | | | |
|---|---|---|---|---|
| 1,390,502 | A | 9/1921 | Clouser | |
| 1,404,894 | A | 1/1922 | Rollins | |
| 2,723,856 | A | 11/1955 | Thomson | |
| 2,858,641 | A | 11/1958 | Trimble | |
| 3,014,307 | A | 12/1961 | Dupuis | |
| 3,204,367 | A | 9/1965 | Stubbmann | |
| 3,978,610 | A | 9/1976 | Stubbmann | |
| 4,188,745 | A | 2/1980 | Harvey et al. | |
| 4,449,321 | A | 5/1984 | Reiling | |
| 4,573,654 | A | 3/1986 | Nottingham | |
| 4,627,588 | A | 12/1986 | Block | |
| 4,640,034 | A | 2/1987 | Zisholtz | |
| 4,664,640 | A | 5/1987 | Shindo et al. | |
| 4,702,719 | A | 10/1987 | Lapid | |
| 4,722,713 | A | 2/1988 | Williams et al. | |
| 4,756,109 | A | 7/1988 | Marcus | |
| 4,880,197 | A | 11/1989 | Wsyzynski | |
| 4,973,286 | A | 11/1990 | Davison | |
| 4,984,380 | A | 1/1991 | Anderson | |
| 5,076,520 | A | 12/1991 | Bro | |
| 5,195,918 | A | 3/1993 | Mozes | |
| D342,117 | S | 12/1993 | Nolan | |
| 5,352,145 | A | 10/1994 | Raiffe et al. | |
| 5,370,570 | A | 12/1994 | Harris | |
| 5,393,075 | A | 2/1995 | Harber | |
| 5,478,268 | A | 12/1995 | Au | |
| 5,480,340 | A | 1/1996 | Bogar | |
| 5,533,936 | A | 7/1996 | Julien et al. | |
| 5,584,531 | A | 12/1996 | Bowman | |
| 5,620,274 | A | 4/1997 | Wear | |
| 5,628,689 | A | 5/1997 | Saint et al. | |
| 5,634,796 | A | 6/1997 | Dollar | |
| 5,672,088 | A | 9/1997 | Chininis | |
| 5,702,039 | A | 12/1997 | Olaiz | |
| 5,709,582 | A | 1/1998 | O'Donnell | |
| D392,126 | S | 3/1998 | Sack | |
| 5,788,014 | A | 8/1998 | Saint et al. | |
| 5,797,785 | A | 8/1998 | Silberstein | |
| 5,803,786 | A * | 9/1998 | McCormick | 446/227 |
| 5,887,945 | A | 3/1999 | Sedlack | |

(List continued on next page.)

FOREIGN PATENT DOCUMENTS

| | | |
|---|---|---|
| WO | WO 02/05917 A1 | 1/2002 |

*Primary Examiner*—Kien T. Nguyen
(74) *Attorney, Agent, or Firm*—Foley & Lardner

(57) ABSTRACT

A non-motorized object hanger for use with a swing having a seat hanger tube supported from a hub and a seat coupled to the seat hanger tube. The object hanger comprises a support member coupled to one of the seat hanger tube and seat. A hanger is coupled to the support member. A decorative object is coupled to the hanger, wherein motion is imparted to the support member by the motion of the swing. Another embodiment provides the support member is offset from the access of the hub.

17 Claims, 8 Drawing Sheets

U.S. PATENT DOCUMENTS 5,928,054 A 7/1999 Mast
5,930,854 A 8/1999 O'Neill et al.
5,939,995 A 8/1999 Phillips
6,016,926 A 1/2000 Smith, II et al.
6,068,285 A 5/2000 Jackson et al.
6,099,377 A 8/2000 Pridemore
6,113,455 A 9/2000 Whelan et al.
6,149,489 A 11/2000 Johnson
6,283,870 B1 9/2001 Saint et al.
6,343,994 B1 2/2002 Clarke
6,447,362 B2 * 9/2002 Khamphilavong et al. .. 446/227
2001/0003695 A1 6/2001 Tell et al.
2001/0028184 A1 10/2001 Sitarski et al.

* cited by examiner

FIG. 3
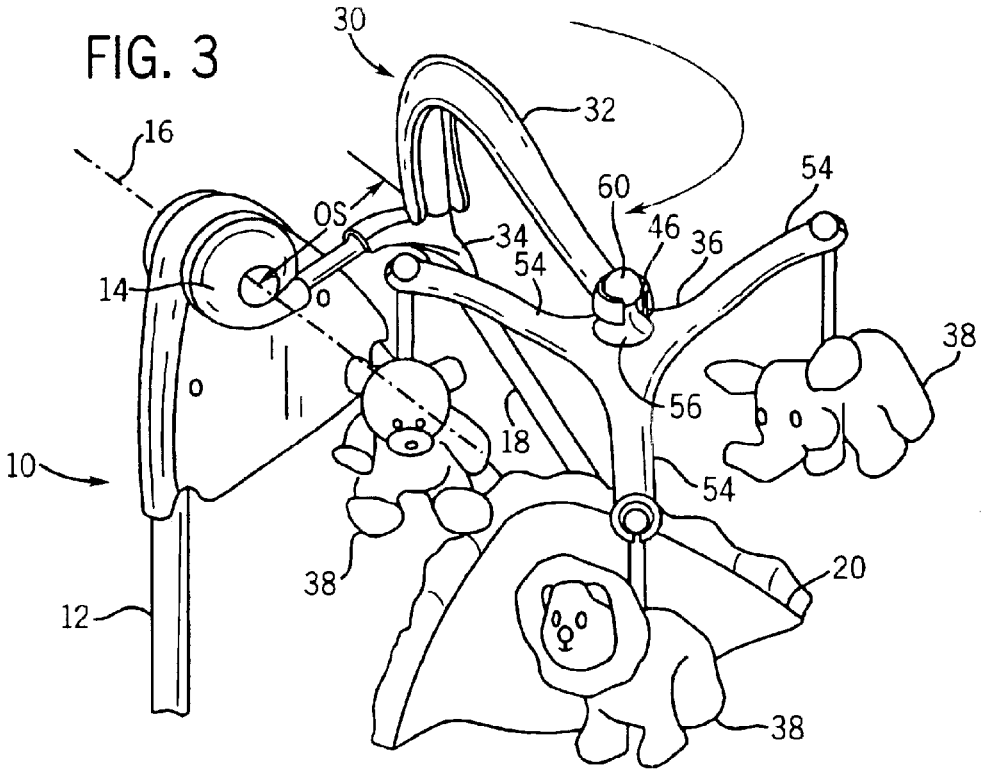
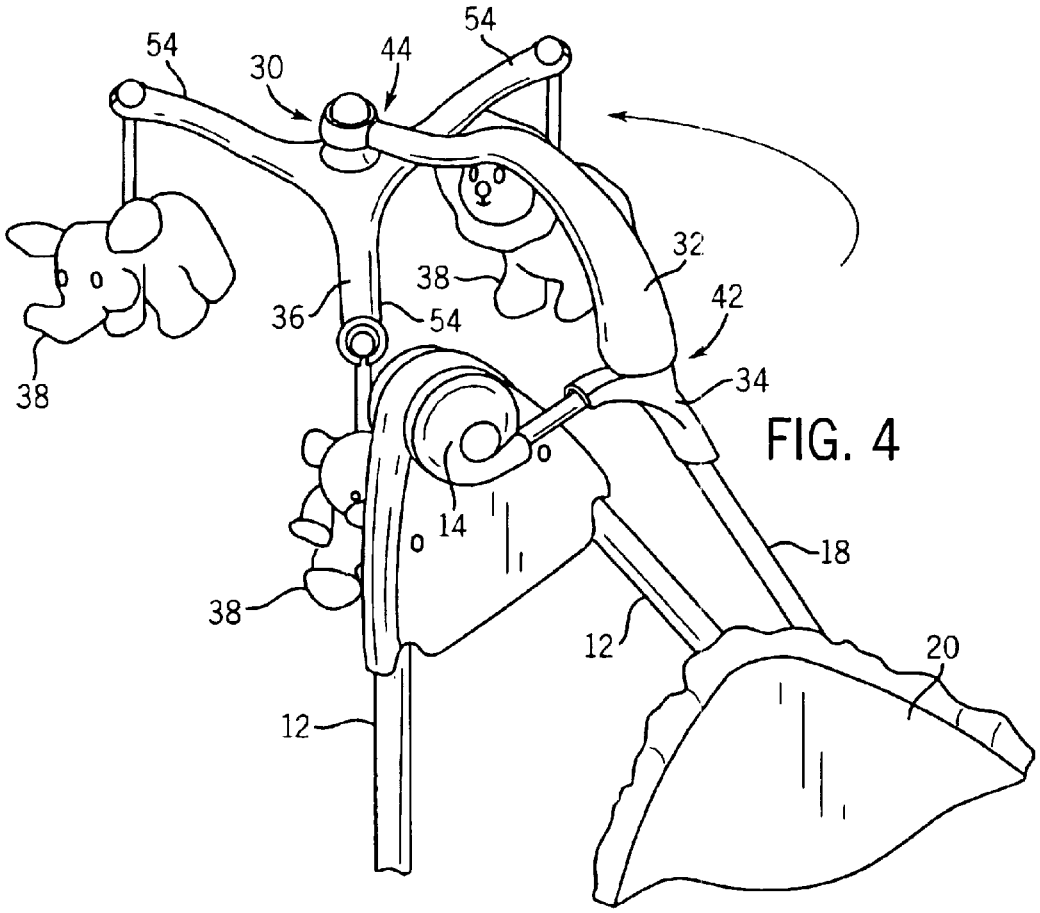
FIG. 4

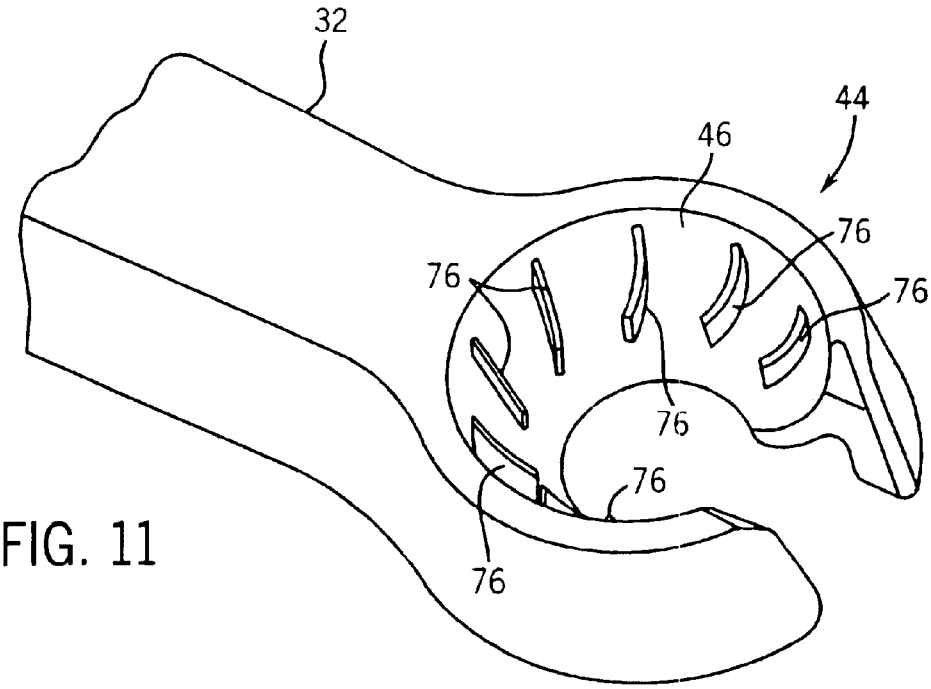
FIG. 11
FIG. 12
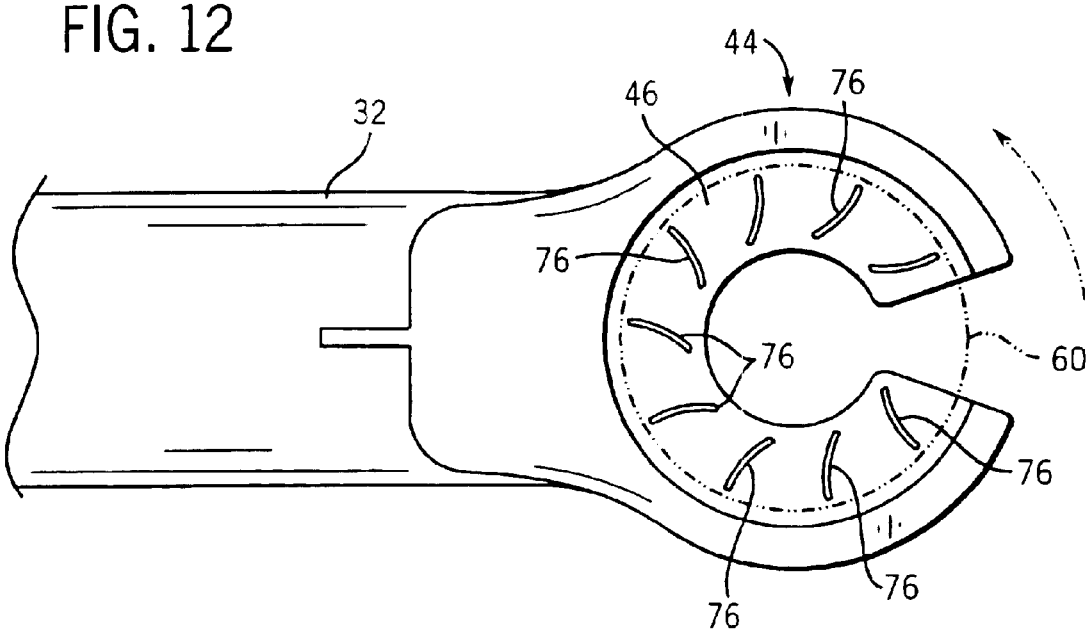

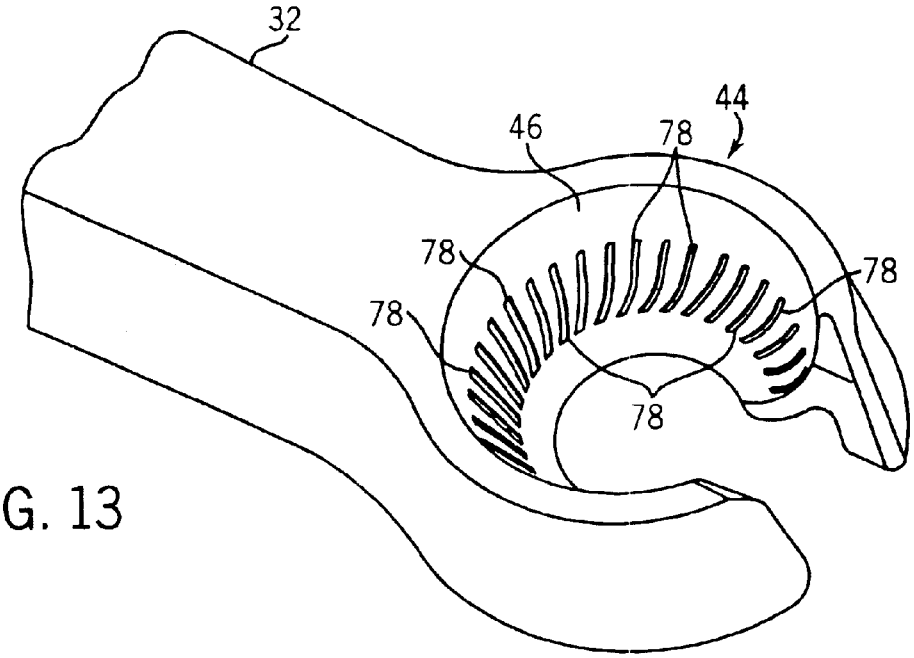
FIG. 13
FIG. 14
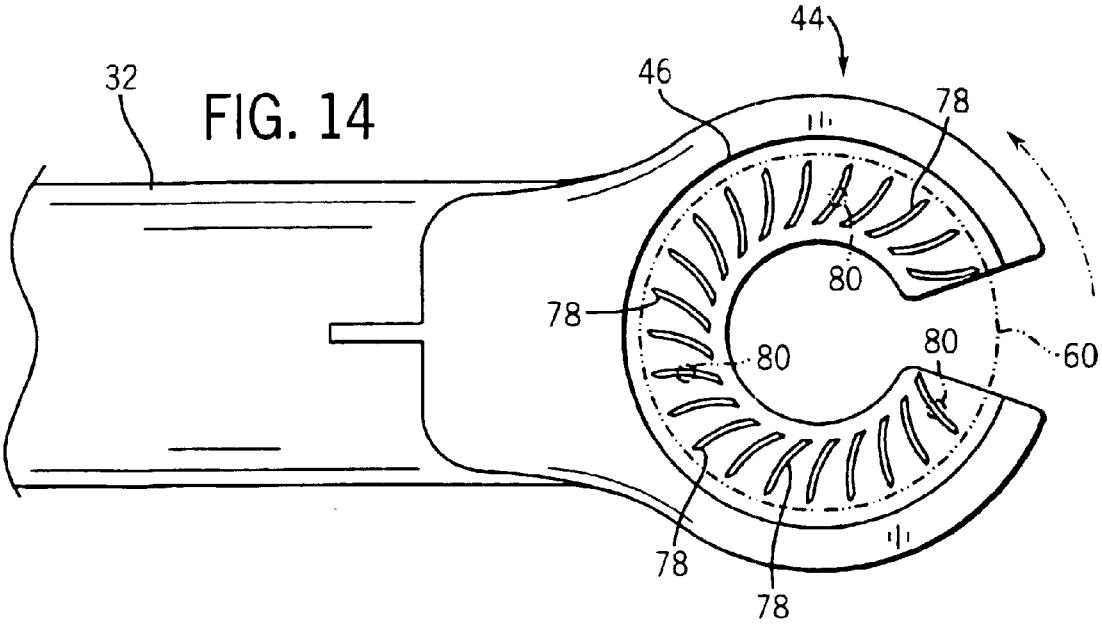

NON-MOTORIZED OBJECT HANGER

BACKGROUND OF THE INVENTION

This invention relates to a child or infant swing and more particularly to a non-motorized object hanger for use with a swing and more particularly to a mobile or toy bar type non-motorized object hanger.

Infant or child swings have been contemplated in the past. For example, open top swings are known to include arrangements that provide decorative objects, such a toys, for a child to interact with while the child is seated in the swing. For example, the child swing seat can include a tray and the toys can be mounted on a support attached to the tray. In such a swing, the toys are positioned in front of the child when the child is seated.

In other arrangements, child care products, such as a stroller or a crib, can include a toy suspension assembly. Motion can be imparted to the toy suspension assembly by motors that are either electrically or spring powered. When the electrical or mechanical power that is fed to the toy suspension assembly is depleted, motion of the toys ceases and the attention of the child is typically diverted and usually accompanied by the child crying. Further, such toy suspension assemblies require constant attention to maintain the motive force, such as supplying batteries or winding the motor spring.

SUMMARY OF THE INVENTION

There is a need for an object hanger for use with a swing that does not require a motor. There is a further need for a non-motorized object hanger for toys so that a child can interact with the toys above the child while sitting back in a swing seat structure. There is also a need for a non-motorized object hanger that can be rotated to several positions with respect to the child, including a position to allow easy placement or removal of the child from the swing seat structure.

There is provided an object hanger for use with a swing having a seat hanger tube supported from a hub and a seat coupled to the seat hanger tube. The object hanger comprises a support member coupled to one of the seat hanger tube and seat. A hanger is coupled to the support member. A decorative object is coupled to the hanger, wherein motion is imparted to the support member by the motion of the swing. In one embodiment, the support member is offset from the axis of the hub.

There is also provided a non-motorized mobile for use with a swing having a hanger tube supported from a hub. The non-motorized mobile comprises a mounting bracket configured to engage the hanger tube. A support arm is coupled to the mounting bracket with the support arm having a distal end. A hanger attachment is coupled to the support arm at the distal end and the hanger attachment is freely movable at the distal end. A hanger is coupled to the hanger attachment. A decorative object is coupled to the hanger, wherein motion is imparted to the mobile by the motion of the swing.

There is further provided a swing comprising a support structure having a hub. A hanger tube is coupled to the support structure at the hub. A seat structure is coupled to the hanger tube. The swing also includes a non-motorized mobile which includes a mounting bracket configured to engage the hanger tube. A support arm is coupled to the mounting bracket with the support arm having a distal end. A hanger attachment is coupled to the support arm at the distal end and freely movable at the distal end. A hanger is coupled to the hanger attachment and a decorative object is coupled to the hanger, wherein motion is imparted to the mobile by the motion of the swing.

BRIEF DESCRIPTION OF THE DRAWINGS

FIG. 3 is an illustration of a mobile coupled to a seat hanger tube of a swing and illustrates rotational placement of the mobile over a seat structure of the swing.

FIG. 4 is an illustration of the mobile shown in FIG. 3 and illustrates rotational placement of the mobile to a side of the swing.

FIG. 11 is a partial perspective view of an embodiment of a non-motorized structure to impart rotating motion to a hanger coupled to the distal end of the support member of a non-motorized object hanger and illustrates angled ribs in the socket of the support member.

FIG. 12 is a top plan view of the non-motorized structure illustrated in FIG. 12 and illustrates a socket ball engaged by the angled ribs to impart rotating motion to the socket ball.

FIG. 13 is a partial perspective view of an embodiment of a non-motorized structure to impart rotating motion to a hanger coupled to the distal end of the support member of a non-motorized motorized object hanger and illustrates angled slots in the socket of the support member.

FIG. 14 is a top plan view of the non-motorized structure illustrated in FIG. 15 and illustrates hemispherical projections on a socket ball engaging the angled slots to impart rotating motion to the socket ball.

DETAILED DESCRIPTION THE PREFERRED EMBODIMENTS

Figure 1:
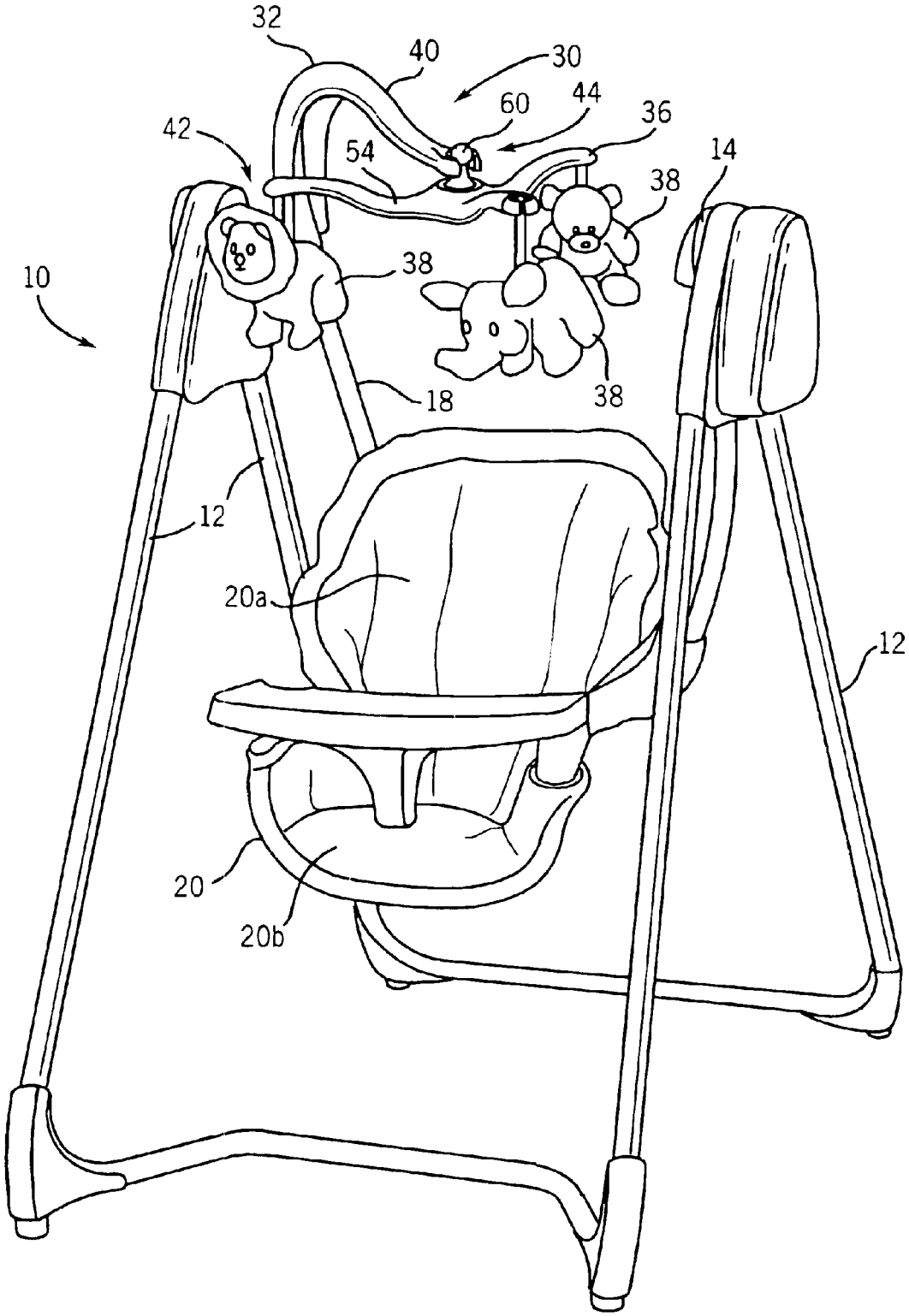
FIG. 1 illustrates a child or infant swing including a mobile type non-motorized object hanger.

Referring now to the figures, FIG. 1 illustrates a perspective view of a child swing 10 that includes a mobile type, non-motorized object hanger 30 for suspending objects, such as toys, above the child seating area. One advantage of such arrangement is that the child seated in the seat can interact with one or more of the decorative objects 38 coupled to the hanger 30.

The swing 10 includes a support frame 12, a housing 13 for a swing drive mechanism, and one or more seat hanger tubes 18 supporting a seat structure 20. The seat structure 20 comprises a seat back 20*a* and a seat bottom 20*b* and may have a tray attached to the seat. The seat structure 20 may also be provided with decorative and comfort-providing materials, such as a seat cushion. The seat structure 20 can also be provided with a folding seat back that can be moved between an upright position and several reclined positions relative to the seat bottom. An actuator apparatus can be provided to facilitate movement of the seat back towards and away from the seat bottom. The actuator apparatus allows the angle between the seat bottom and seat back to be adjusted as desired.

Figure 2:
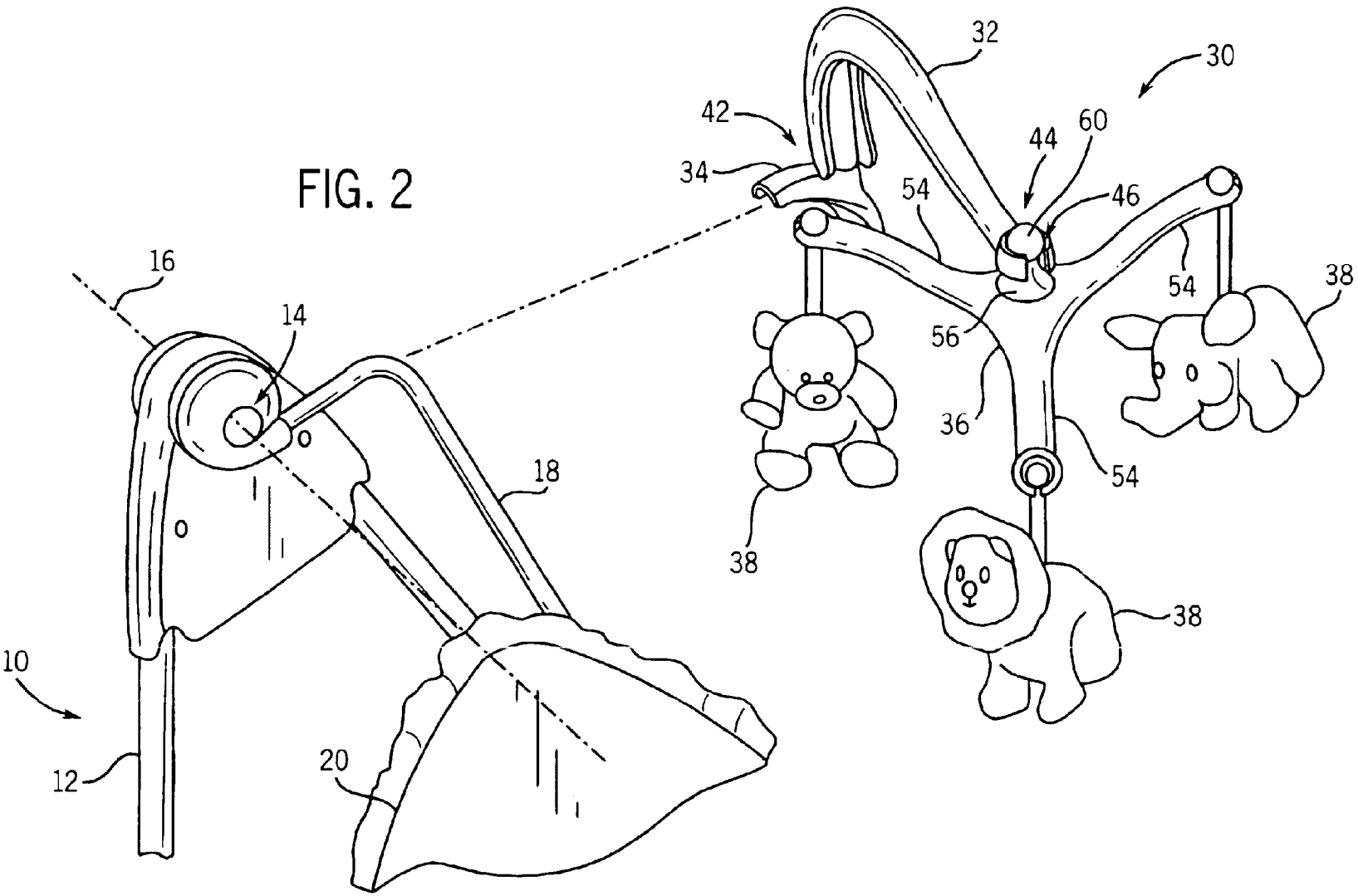
FIG. 2 is an illustration of an exemplary embodiment of a mobile type non-motorized object hanger and depicts its placement on a seat hanger tube of a swing.

FIG. 2 illustrates an exemplary embodiment of a non-motorized object hanger 30 for use with a swing 10. A support member 32 is coupled to one of the seat hanger tubes 18. The support member 32 is offset from the axis 16 of the hub 14 of the swing 10 by an offset distance OS (see FIG. 3). The offset distance OS can be conveniently controlled by the configuration of the hanger tube 18 as determined by the manufacturer of the swing 10. The offset distance OS facilitates the motion imparted to the object hanger 30.

A hanger 36 is coupled to the support member 32 and at least one decorative object 38 is coupled to the hanger. Motion is imparted to the support member 32 by the motion of the swing 10. The motion of the support member 32 in turn moves the decorative object(s) 38, typically in a pendulant arc.

Figure 15:
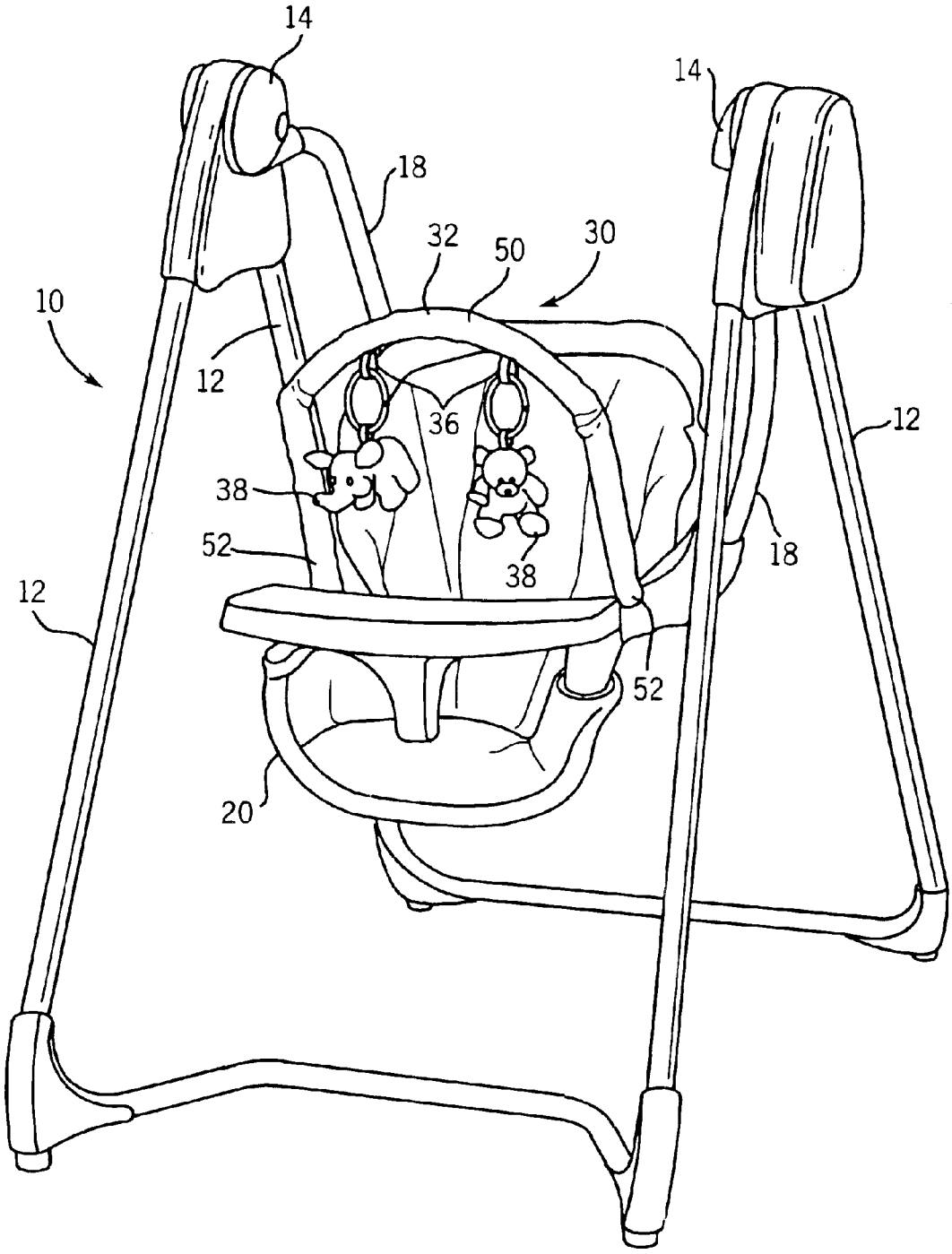
FIG. 15 illustrates a child swing including an exemplary embodiment of a toy bar type non-motorized object hanger.

One embodiment of the object hanger 30 configures the support member 32 as a toy bar 50 that can be coupled to the seat 20. As shown in FIG. 15, the support member 32 is configured as a toy bar 50 with each end 52 of the toy bar 50 coupled to the seat 20. Decorative objects 38 are suspended from the toy bar 50 by hangers 36.

FIG. 2 illustrates the non-motorized object hanger 30 with the support member 32 configured as an arm 40 having a proximal end 42 and a distal end 44. The proximal end 42 is coupled to a mounting bracket 34 configured to engage a seat hanger tube 18. The distal end 44 is configured to engage the hanger 36. It should be understood that the support member 32 can be mounted on either of the seat hanger tubes 18. It is also contemplated that a non-motorized object hanger 30 can be coupled to each seat hanger tube 18, thereby providing a variety of decorative objects 38 in proximity to the child in the swing 10.

The non-motorized object hanger 30, such as the mobile depicted in FIGS. 3 and 4, includes a mounting bracket 34 configured to releasably engage the hanger tube 18. The support member 32 is coupled to the mounting bracket 34 at its proximal end 42. A hanger attachment 56 is coupled to the support member 32 at the distal end 44 and freely movable at the distal end 44. The hanger attachment 56 is provided with a socket ball 60 which engages a socket 46 formed in the distal end 44 of the support member 32. The hanger 36 is coupled to the hanger attachment 56 with the socket ball 60 engaging the socket 46. See FIG. 5. The hanger 36 and the hanger attachment 56 can be integrally molded together.

The hanger 36 can be provided with a plurality of radially extending arms 54. The illustrated hanger 36 provides three equally spaced radially extending arms 54. As discussed above, any number of arms can be provided on the hanger 36. A typical arrangement is that each arm 54 supports an object 38. It should be noted that such arm 54 can include a socket 46 and socket ball 60 arrangement to couple a decorative object 38 to the hanger 36.

The support member 32 is rotatable in the mounting bracket 34. The ability to rotate the support member 32 allows a caregiver to move the support to several different positions as determined by the caregiver. FIG. 3 depicts the support member 32 extending over the seat 20, and FIG. 4 depicts the support member 32 moved away from the seat 20. In the latter position, a child can easily be moved in or out of the seat 20 of the swing 10.

Figure 5:
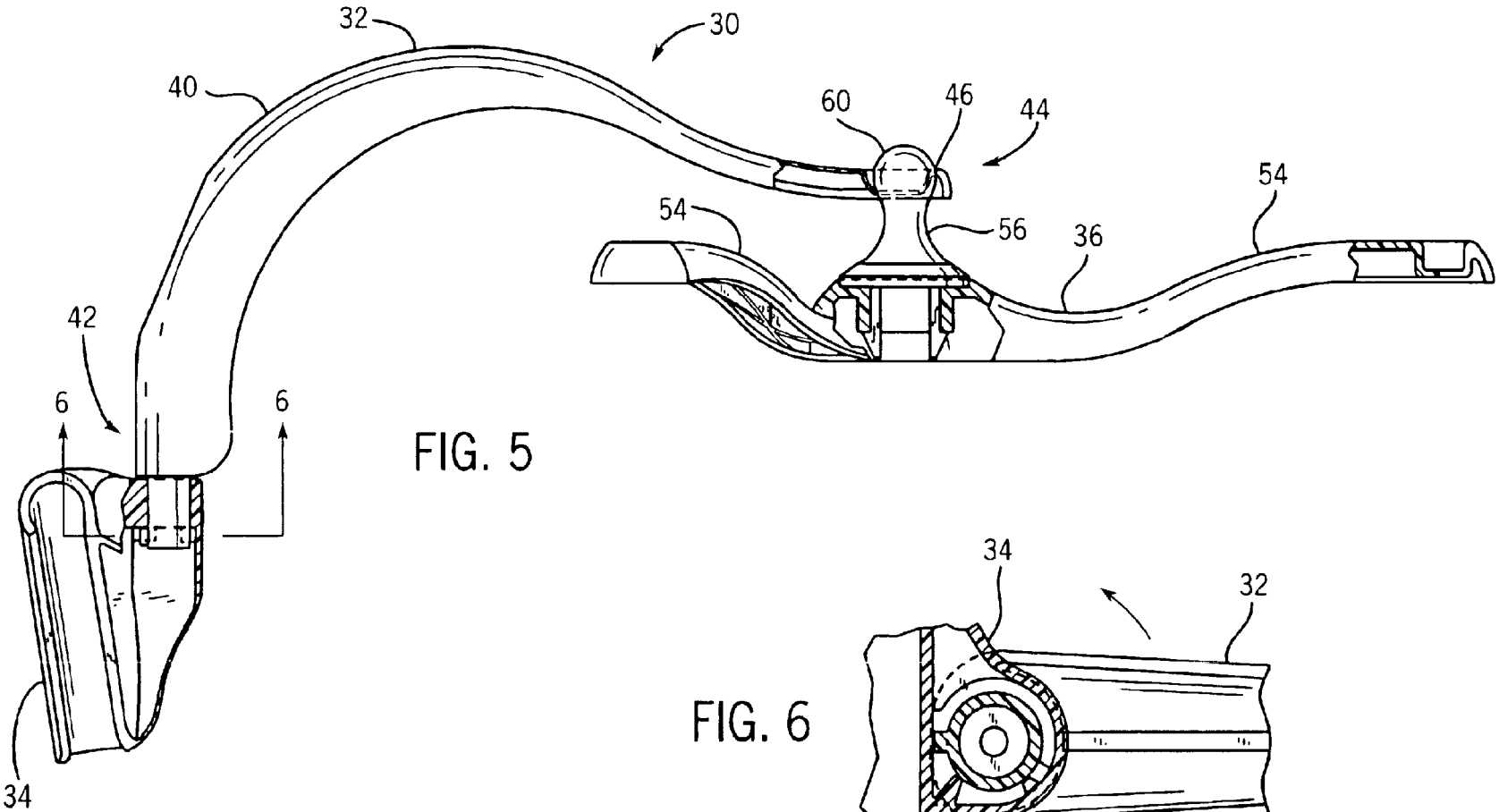
FIG. 5 is a partial sectional side view of an exemplary embodiment of a mobile type non-motorized object hanger.
Figure 6:
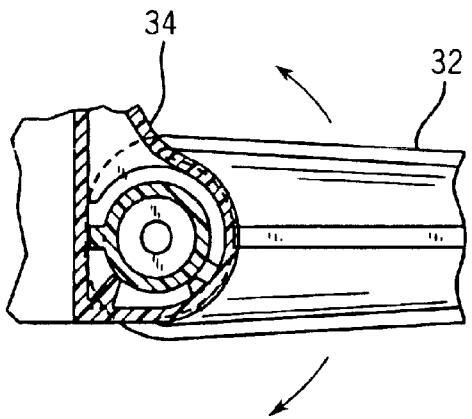
FIG. 6 is a partial sectional detailed view of the proximal end of a support member coupled in a mounting bracket of the mobile type non-motorized object hanger illustrated in FIG. 5 along the line 6—6.
Figure 7:
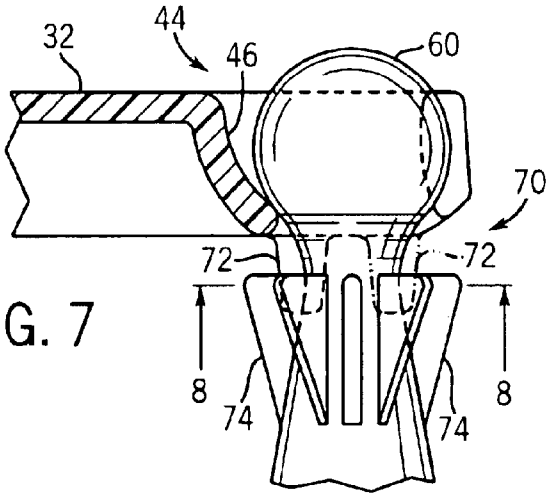
FIG. 7 is a partial sectional view of one embodiment of a non-motorized structure to impart rotating motion to a hanger of a non-motorized object hanger.

FIG. 5 illustrates an exemplary embodiment of a non-motorized mobile for use with a swing 10, and FIG. 6 depicts the pivot of the support member 32 in the mounting bracket 34 which allows rotation of the support member 32. The support member 32 is positionable above the seat structure 20 such that a child seated in the seat can interact with one or more of the decorative objects 38 coupled to the hanger 36 of the object hanger 30.

Figure 10:
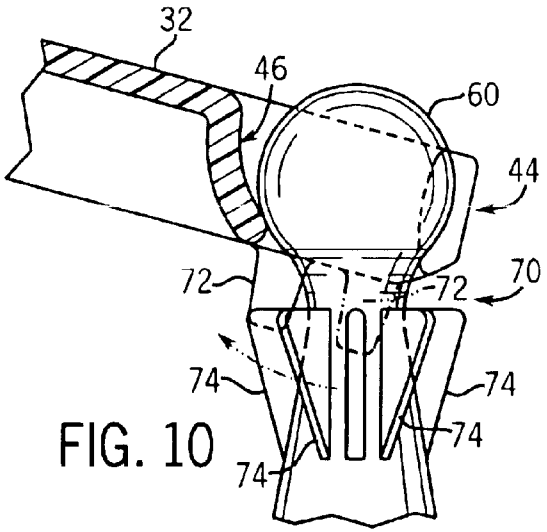
FIG. 10 is an illustration of the non-motorized structure imparting additional rotational motion to the hanger of the non-motorized object hanger illustrated in FIG. 7.
Figure 8:
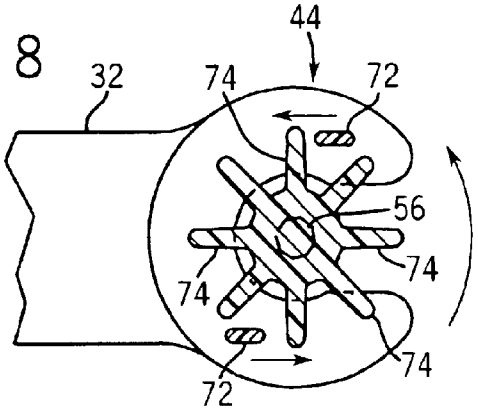
FIG. 8 is a cross-sectional view of the non-motorized structure illustrated in FIG. 7 along the line 8—8.
Figure 9:
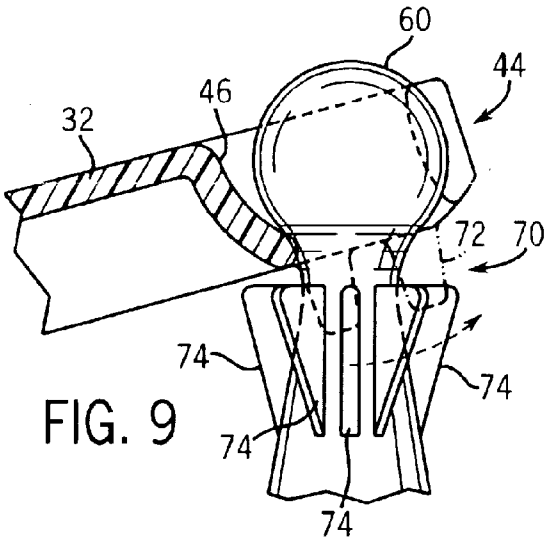
FIG. 9 is an illustration of the non-motorized structure imparting rotational motion to the hanger of the non-motorized object hanger illustrated in FIG. 7.

According to another aspect of the invention, the non-motorized object hanger 30 can include a non-motorized structure 70 to impart rotating motion to the hanger 36 and thereby to the decorative object 38. One embodiment of such non-motorized structure 70 is illustrated in FIGS. 7–10. In this embodiment, the hanger attachment 56 is provided with a plurality of circumferentially placed fins 74. A pair of fingers 72 are provided on the distal end 44 of the support member 32. Typical placement is as shown in FIG. 8 on the under side of the socket 46. As the support member 32 and hanger 36 moves with the motion of the swing 10, the support member 32 orientation with respect to the hanger attachment 56 is angular as depicted in FIGS. 9 and 10. The motion of the hanger attachment 56 causes the fingers 72 to push against the fins 74, causing the hanger attachment 56 and the coupled hanger 36 to rotate within the socket 46. The illustrations depict rotation in a counter-clockwise direction; however, it should be understood that clockwise rotation is also possible depending on the orientation of the fingers 72 on the support member 32.

Another embodiment of a non-motorized structure 70 for rotation is depicted in FIGS. 11 and 12. FIG. 11 illustrates the distal end 44 of the support member 32. The socket 46 at the distal end of the support member 32 has a plurality of angled ribs 76. The tops of the ribs 76 are configured to match the circumference of the socket ball 60 and are also angled relative to the longitudinal axis of the support member 32. The ribs 76 can be composed of plastic and molded in the socket, or they can be composed of plastic or metal as separate members inserted into the socket or attached with an adhesive. An alternative configuration for the ribs 76 is to provide a spring steel wire positioned in the socket 46. In these configurations, the ribs 76 catch on the surface texture of the socket ball 60. Due to the angular position of the ribs 76 and the swaying motion of the socket ball 60 within the socket 46 of the support member 32, a rotation is imparted to the socket ball 60, which in turn rotates the hanger 36. The rotation motion is governed by the orientation of the ribs 76. FIG. 12 illustrates a counterclockwise rotation, but a clockwise rotation can be obtained based on the rib 76 orientation. It is also contemplated that the socket ball 60 can be provided with the angled ribs 76, with the ribs 76 engaging the surface texture of the socket 46.

Another embodiment of a non-motorized structure 70 for rotation is depicted in FIGS. 13 and 14. A plurality of slots 78 are provided in the socket 46 at the distal end 44 of the support member 32. The slots 78 are angled relative to the longitudinal axis of the support member 32. The slots 78 can pierce all the way through the hanger arm, or they may be configured to a non-piercing depth in the socket 46. One edge of the slot 78 is sharp, while the other edge is radiused to facilitate the rotary motion in one direction. In this embodiment, the socket ball 60 is provided with hemispherical projections 80 evenly spaced around its lower surface to engage with the slots 78. See FIG. 14. As the non-motorized object hanger 30 moves with the motion of the swing 10, the support member 32 swings back and forth. Such motion tilts the socket 46, which allows the hemispherical projections 80 on the socket ball 60 to engage the slots 78. This engagement rotates the socket ball 60 and the hanger 36. As the swing motion continues, the hemispherical projections 80 enter and exit the slots 78. Because of the angled orientation of the slots 78, a rotation to the socket ball 60 is provided. The orientation of the slots 78 determine the direction of rotation and, as depicted in FIG. 14, the rotation is in a counter-clockwise direction. It should be understood that a different orientation of the slots would impart a clockwise rotation to the socket ball 60. It is also contemplated that the socket ball 60 can be provided with the slots 78 that are configured to engage raised projections 80 on the surface of the socket 46.

The non-motorized object hanger 30 is typically positioned such that the decorative objects 38 are at a height above the child seating area such that the child may readily interact with the decorative objects 38. In this application, interact means that the child can at least touch the decorative objects 38 when seated back in the seat structure 20. In other words, the child need not sit forward from the seat back in order to touch the decorative objects 38. The decorative objects 38 may include, for example, a string or clip where the decorative objects can be tied or clipped to the hanger 36.

Another embodiment provides the decorative object 38 with the non-motorized structure 70, the non-motorized structure including a socket ball 60 and a socket 46, with the socket 46 formed in the hanger 36. The operation of such embodiment is similar to that described above for the hanger 36 rotation in the socket 46 of the support member 32.

After describing above several exemplary embodiments of a non-motorized object hanger for use with a swing in accordance with the invention, there are several general comments. The non-motorized object hanger illustrated in the several figures includes decorative objects that are covered by soft goods, such as fabric or cushioning material. It should be understood that the decorative objects can be made of other conventional and convenient material such as plastic, wood or metal. The decorative objects can also be three-dimensional or relatively flat and they can also include sound effect elements and lighting elements.

The non-motorized object hanger components can be composed of any suitable material that is appropriate and compatible for use as a object hanger with a child swing. For example, it can be composed of plastic, such as a polyvinylchloride or polyurethane, that can be injection molded, blow molded or vacuum molded. The support components can also be composed of metal that is formed, for example, by stamping or rolling. It should also be understood that the several support components can be of any convenient or suitable shape. The illustrated support member is curved; however, it can be of any other appropriate shape such as straight or stepped, or the like. The hanger from which the decorative objects are suspended includes arms and can have any number of arms. The illustrated hanger shows three radially extending arms; however, any number of arms can be utilized. It is preferred that the arms facilitate a balanced display which is also accomplished by controlling the weight of the various decorative objects coupled to the hanger. The aesthetics of the non-motorized object hanger and the fabricating processes are determined by the manufacturer of the object hanger.

Thus, there is provided a non-motorized object hanger 30 for use with a swing 10. There is also provided a non-motorized structure 70 to impart rotation motion to the hanger 36. While the embodiments illustrated in the figures and described above are presently preferred, it should be understood that these embodiments are offered by way of example only. The invention is not intended to be limited to any particular embodiment but is intended to extend to various modifications that nevertheless fall within the scope of the appended claims. It is contemplated that a timing mechanism to change the period of motion of the swing can be provided, and it is also contemplated that the swing may be provided with an electric or mechanical motor. It is also contemplated that the seat structure of the swing may be removable and function in other configurations. In this application, child is intended to include an infant. Additional modifications such as those described at the beginning of and in the body of the description above will be evident to those with ordinary skill in the art.

What is claimed is:

1. A swing comprising:

a seat;

a seat hanger supporting the seat; and an object hanger, the object hanger comprising:

a support member coupled to one of the seat hanger and seat;

a hanger coupled to the support member; and a decorative object coupled to the hanger, wherein motion is imparted to the support member by the motion of the swing.

2. The swing of claim 1, wherein the object hanger further comprises a mounting bracket configured to engage the seat hanger, and the support member is configured as an arm having a proximal end and a distal end, the proximal end being coupled to the mounting bracket and the distal end configured to engage the hanger.

3. The swing of claim 2, wherein the support member includes, at the distal end, a non-motorized structure to impart rotating motion to the hanger.

4. The swing of claim 1, further comprising a hub supporting the seat hanger, wherein the support member is offset from the axis of the hub.

5. The swing of claim 1, wherein the hanger is configured to support multiple decorative objects.

6. The swing of claim 1, wherein the hanger includes a non-motorized structure to impart rotating motion to the decorative object.

7. The swing of claim 1, wherein the support member is positionable above the seat such that a child seated in the seat can interact with the decorative object.

8. The swing of claim 1, wherein the support member is a toy bar, with each end of the toy bar coupled to the seat.

9. The swing of claim 1, wherein the support member is a toy bar.

10. A swing comprising:

a support structure having a hub;

a hanger tube coupled to the support structure at the hub;

a seat structure coupled to the hanger tube; and, a non-motorized mobile; the non-motorized mobile including:

a mounting bracket configured to engage the hanger tube;

a support arm coupled to the mounting bracket, with the support arm having a distal end;

a hanger attachment coupled to the support arm at the distal end, and freely movable at the distal end;

a hanger coupled to the hanger attachment; and a decorative object coupled to the hanger, wherein motion is imparted to the mobile by the motion of the swing.

11. The swing of claim 10, wherein the hanger includes a plurality of radial extending arms.

12. The swing of claim 11, wherein each arm supports a respective decorative object.

13. The swing of claim 10, wherein the support arm is rotatable in the mounting bracket.

14. The swing of claim 10, wherein the mounting bracket is offset from the axis of the hub.

15. The swing of claim 10, wherein the hanger attachment includes a non-motorized structure to impart rotating motion to the hanger.

16. The swing of claim 10, wherein the hanger includes a non-motorized structure to impart rotating motion to the decorative object.

17. The swing of claim 10, wherein the support arm is positionable above the seat structure such that a child seated in the seat structure can interact with the decorative object.

* * * * *